US005845174A

United States Patent [19]

Yasui et al.

[11] Patent Number: 5,845,174

[45] Date of Patent: Dec. 1, 1998

[54] IMAGE FORMING APPARATUS EQUIPPED WITH CLEANING DEVICE

[75] Inventors: Masato Yasui; Kazunobu Maekawa; Seiichi Munemori; Kuniaki Ishiguro, all of Toyokawa, Japan

[73] Assignee: Minolta Co., Ltd., Osaka, Japan

[21] Appl. No.: 821,350

[22] Filed: Mar. 20, 1997

[30] Foreign Application Priority Data

Mar. 21, 1996 [JP] Japan ..... 8-064592

[51] Int. Cl.[6] ..... G03G 15/16; G03G 21/00

[52] U.S. Cl. ..... 399/101; 399/71; 399/303; 430/125; 430/126

[58] Field of Search ..... 399/43, 81, 92, 399/98, 101, 303, 349, 354, 355, 71; 430/125, 126

[56] References Cited

U.S. PATENT DOCUMENTS

| | | | |
|---|---|---|---|
| 4,483,610 | 11/1984 | Takada | 399/303 |
| 4,975,734 | 12/1990 | Mishima | 355/70 |
| 4,998,143 | 3/1991 | Kumasaka et al. | 399/101 |
| 5,619,746 | 4/1997 | Kubo et al. | 399/101 X |
| 5,678,134 | 10/1997 | Miki et al. | 399/349 X |

FOREIGN PATENT DOCUMENTS

| | | |
|---|---|---|
| 3-102380 | 4/1991 | Japan . |
| 3-102385 | 4/1991 | Japan . |

*Primary Examiner*—Arthur T. Grimley
*Assistant Examiner*—Sophia S. Chen
*Attorney, Agent, or Firm*—McDermott, Will & Emery

[57] ABSTRACT

An image forming apparatus equipped with a monochrome mode and color mode, in which the transfer drum is made to rotate without any paper wrapped around it to clean the transfer drum each time a series of copy operations is completed. By controlling the cleaning period through increasing or decreasing the number of non-paper rotations in response to the last copy operation mode, the transfer drum may be adequately cleaned at all times, and the amount of wear on the transfer drum and cleaning device caused by the cleaning operation is reduced.

18 Claims, 11 Drawing Sheets

IMAGE FORMING APPARATUS EQUIPPED WITH CLEANING DEVICE

BACKGROUND OF THE INVENTION

1. Field of the Invention

The present invention pertains to an image forming apparatus having a function to transfer the toner image onto a sheet of paper held by a supporting means such as a transfer drum or transfer belt, and more particularly to the cleaning of said supporting means.

2. Description of the Related Art

Image forming apparatuses, such as color copying machines, that have a function to transfer the toner image onto a sheet of paper held by a supporting means such as a transfer drum are conventionally known. In these image forming apparatuses, toner sometimes adheres to areas of the supporting means that are not being used to hold the paper. When the next sheet of paper is held onto any of these areas to which the toner is adhering, the back side of said sheet becomes smeared.

With this as a backdrop, image forming apparatuses have been proposed that incorporate a cleaning device to clean the surface of the supporting means. In a conventional image forming apparatus with a cleaning device, cleaning of the supporting means is carried out by the cleaning device for a certain period of time after a series of image forming operations has been completed, or when the apparatus is reset, while said supporting means is not holding any paper. Where the supporting means is a transfer drum, the transfer drum is cleaned by the cleaning device by causing the drum to rotate a prescribed number of times without paper around it. In this way, cleaning is carried out using the constant cleaning capacity of conventional image forming apparatuses.

However, the degree of contamination of the supporting means varies over time and depends on the mode present. Therefore, where the level of contamination is low, cleaning may be performed to an unnecessary extent. As the cleaning capacity increases, e.g., by increasing the cleaning period, additional excess stress is applied to the supporting member and its life is shortened.

In the case of a construction in which the image carrier is driven when the supporting member is cleaned, such as where the image carrier is a photosensitive drum, as the cleaning period increases, excess stress is applied to the image carrier as well and the life of the image carrier is also shortened. In contrast, if the cleaning capacity is made uniformly smaller, while the application of excess stress to the supporting member or the image carrier may be prevented, adequate cleaning may not be performed when the level of contamination of the supporting member is high. Conventional image forming apparatuses have these problems.

OBJECT AND SUMMARY

The primary object of the present invention is to provide an image forming apparatus capable of reliably cleaning the supporting member without performing unnecessary cleaning.

In order to achieve the object described above, the image forming apparatus comprises an image carrier that carries the toner image, a developing device that forms the toner image on said image carrier, a supporting mechanism that holds paper so that it faces said image carrier, a transfer member that transfers the toner image carried on said image carrier onto the paper held by said supporting mechanism, a cleaning device that cleans the surface of said supporting mechanism, and a controller that controls the cleaning capacity of said cleaning device in response to the conditions of operation to form an image on the paper using said components.

Using the construction described above, the cleaning capacity of the cleaning device is controlled in response to the conditions of the image forming operation. In other words, where the operating conditions are such that the level of contamination of the supporting mechanism is low, the cleaning capacity is set to be low as well, while where the operating conditions are such that the level of contamination is high, the cleaning capacity is also set high. This allows adequate cleaning of the supporting mechanism at all times and also reduces the excess stress on the supporting mechanism and the cleaning device, allowing their life spans to be lengthened.

These and other objects, advantages and features of the invention will become apparent from the following description thereof taken in conjunction with the accompanying drawings which illustrate specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENT

Figure 1:
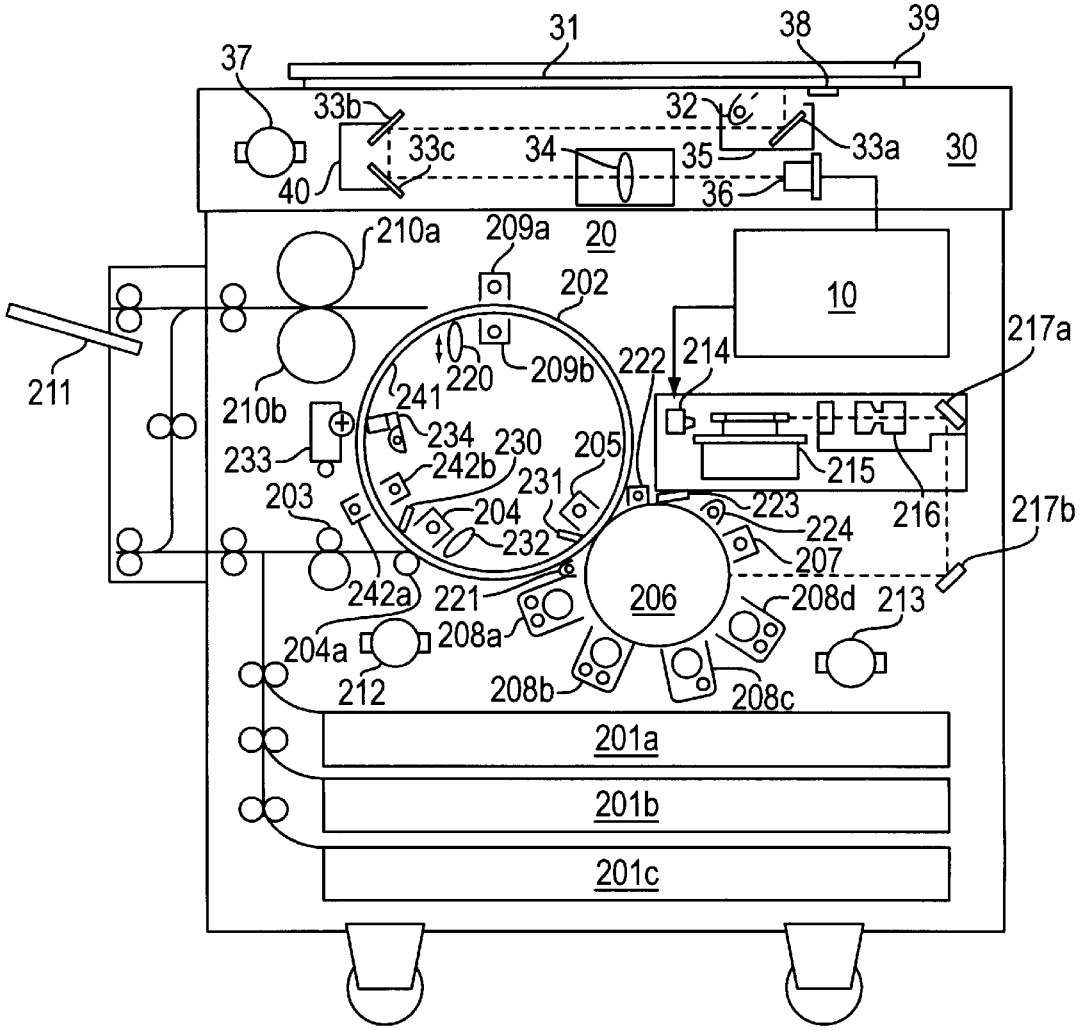
FIG. 1 is a cross-sectional view showing the entire construction of a copying machine, one embodiment of the present invention.

FIG. 1 shows the entire construction of a digital color copying machine, which is one embodiment of the present invention.

The digital color copying machine reads an original sheet using image scanner 30 and processes signals by means of digital signal processing unit 10. Printer 20 prints out in full color the image corresponding to the original image read by image scanner 30.

In image scanner 30, the original placed on platen glass 31 is pressed down by platen cover 39. The original on platen glass 31 is irradiated by lamp 32. Its image is guided by mirrors 33*a*, 33*b* and 33*c*, and is formed via lens 34 on linear full color sensor (CCD) 36, whereupon it is converted into full color information comprising red (R), green (G) and blue (B) components and sent to signal processing unit 10. Through the driving of scanner motor 37, first slider 35 and second slider 40 mechanically move perpendicular to the electronic scanning direction of linear full color sensor 36 at speed V and speed V/2, respectively, and scans the entire original. White plate 38 used for shading correction is located at one edge of platen glass 31. Signal processing unit 10 electronically processes the signals read. It then breaks them down into magenta (M), cyan (C), yellow (Y) and black (Bk) components and sends them to printer 20. Each time the original is scanned by image scanner 30, one of the separate components of cyan, magenta, yellow or black is sent in sequence to printer 20. The printout process is completed when the original is scanned four times.

The cyan, magenta, yellow and black image signals sent from signal processing unit 10 modulate the drive of semiconductor laser 214 by means of the laser diode drive (PHC unit) in accordance with the image signal level. The laser light scans photosensitive drum 206 via polygonal mirror 215, f-θ lens 216 and reflecting mirrors 217*a* and 217*b*.

The developing unit comprises cyan, magenta, yellow and black developers 208*a*, 208*b*, 208*c* and 208*d*, which develop the electrostatic latent image formed on photosensitive drum 206 using negatively charged toner.

On the other hand, paper fed by paper feeder 201*a*, 201*b* or 201*c* is wrapped around transfer drum 202 by means of adsorption charger 204 at prescribed timing controlled by timing roller 203, is pressed against the transfer drum 202 by a backup roller 204*a* and is conveyed to the transfer position, at which the image developed on photosensitive drum 206 is transferred to the paper by means of transfer charger 205. Adsorption pusher 230 and transfer pusher 231 are located next to adsorption charger 204 and transfer charger 205, respectively. Adsorption pusher 230 and transfer pusher 231 are made to come into contact with or move away from the inner surface of transfer drum 202 by means of solenoids not shown in the drawing. After the four colors, i.e., cyan, magenta, yellow and black, are sequentially transferred in this way, the paper is separated by separation chargers 209*a* and 209*b* and pushing member 220, and is conveyed to fusing rollers 210*a* and 210*b*. The paper that has passed through fusing rollers 210*a* and 210*b* is then ejected onto paper exit tray 211. The transfer drum 202 and photosensitive drum 206 are driven by a transfer drum motor 212 and photosensitivity drum motor 213, respectively.

After the paper is separated, the charge on dielectric film 241 that comprises the surface of transfer drum 202 is removed by dischargers 242*a* and 242*b*. Discharge member 232 is located downstream from adsorption charger 204 in order to prevent defective image transfer caused by the discharge that occurs when the paper separates from adsorption roller 204*a* immediately after the paper adsorption is completed.

When the image transfer onto the paper on transfer drum 202 by means of transfer charger 205 is completed, photosensitive drum 206 is negatively charged by pre-cleaner charger 222, residual toner is removed from the surface of photosensitive drum 206 by cleaner 223, and the residual charge is removed by eraser 224. Photosensitive drum 206 is then charged again by charger 207, a latent image is formed on it by means of the laser light, and the image is then developed by developing unit 208. The discharge by pre-transfer eraser 221 is performed in order to make the transfer electric field uniform by reducing the charge of non-developed areas to prevent defective image transfers, including a defective transfer in which only the edges of the image are transferred and the uniform toner density areas are not transferred.

Figure 2:
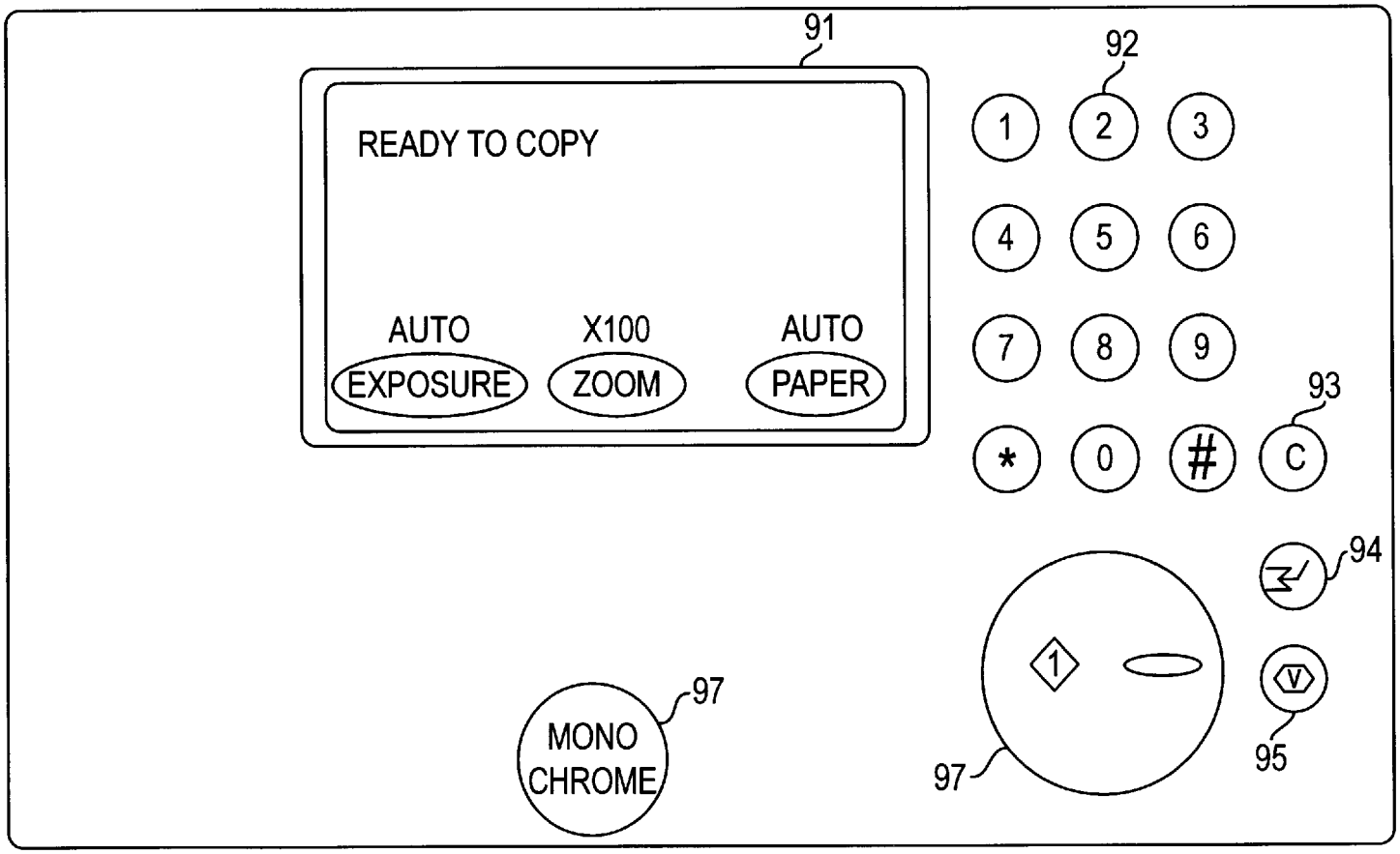
FIG. 2 is a front elevation of the operation panel.
Figure 3:
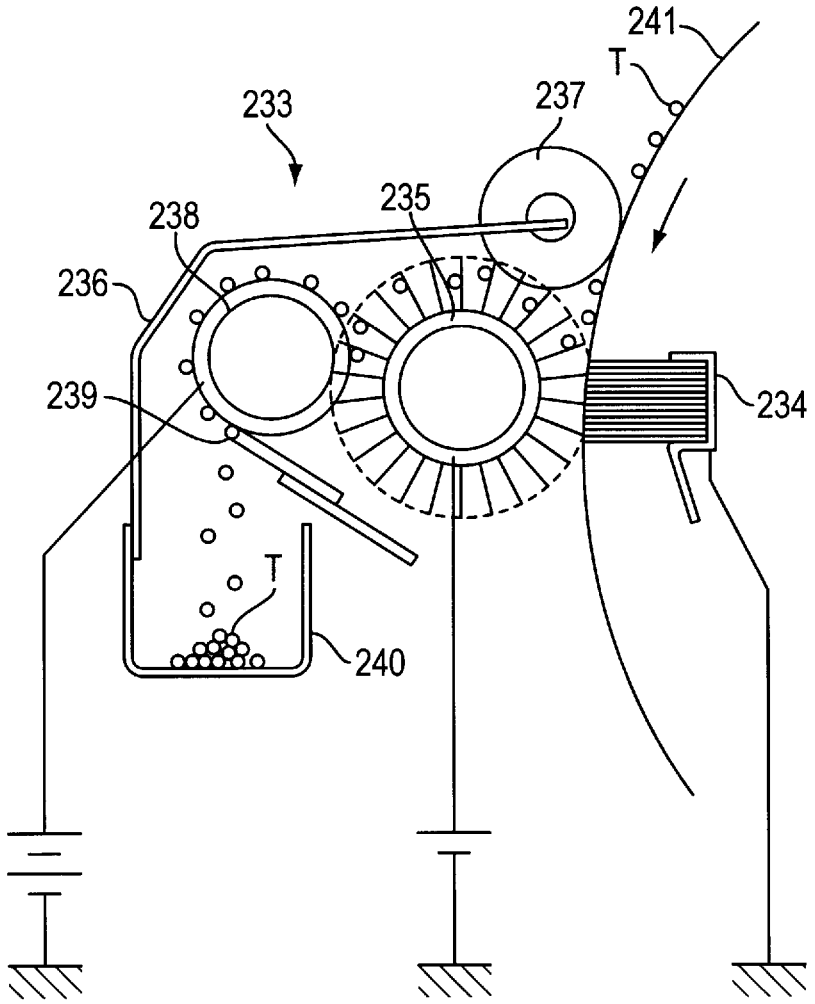
FIG. 3 is a cross-sectional view showing the cleaning device.

FIG. 2 shows the operation panel of the digital color copying machine. In the drawing, 92 is a numeric keypad used to input the number of copies to be made, 93 is a clear key to set said number to 1, 94 is an 'Interrupt' key to send an instruction to perform interrupt copying, 95 is a 'Stop' key to discontinue the copy operation and 96 is a 'Print' key to send an instruction to start the copy operation. 91 is a touch panel and has a function to display the number of copies that was input as well as a function to input and display various operating conditions. Specifically, by pressing the area indicating 'Exposure', the 'automatic exposure setting mode' may be set, in which the most appropriate output exposure is automatically set in accordance with the density and darkness of the original. By pressing the area indicating 'Zoom', a copy magnification may be set, and by pressing the area indicating 'Paper', the 'automatic paper selection mode', in which the most appropriate paper size is automatically selected in accordance with the size of the original, may be set, or any desired paper size may be designated. The drawing shows a situation in which the automatic darkness setting mode, 100% magnification and automatic paper selection mode are present. 97 is a self-illuminating monochrome key. Each time this monochrome key 97 is pressed, the copying machine alternates between monochrome mode in which copying is carried out using black toner and color mode in which copying is carried out using colors. Monochrome key 97 is illuminated when in monochrome mode and is not illuminated in color mode.

The details of cleaning device 233 located to the left of the outer surface of transfer drum 202 will now be explained. Cleaning device 233 removes contaminating toner T that is directly transferred onto transfer drum 202 due to a problem such as a paper jam, or that is splashed from photosensitive drum 206, etc., onto the surface of transfer drum 202 and makes said surface dirty. Cleaning device 233 may be rotated between a contact position at which it is pressed into contact with the surface of transfer drum 202 and a non-contact position at which it is moved away from said surface. This rotating operation is carried out by contact cam 58 (see FIG. 4).

Cleaning device 233 is pressed into contact with transfer sheet 241 on the surface of transfer drum 202 when it is at the contact position. It has as its main component cleaning brush 235 which adsorbs contaminating toner T on transfer drum 202 and removes it. Cleaning brush 235 is supported by frame 236 of cleaning device 233. In addition, as shown in the drawing, cleaning brush 235 receives a bias voltage so that it has a polarity opposite from that of toner T, i.e., a positive polarity. Thus, when cleaning brush 235 is pressed into contact with transfer drum 202, it electrostatically adsorbs contaminating toner T on transfer drum 202, thereby cleaning the surface of transfer drum 202.

Positioning roller 237 is located above cleaning brush 235. Positioning roller 237 is rotatably attached to the right upper area of frame 236. Positioning roller 237 moves on the surface of transfer drum 202 while rotating when cleaning device 233 is pressed into contact with transfer drum 202, and determines the pressure with which cleaning brush 235 is pressed against transfer drum 202, or in other words, the position of cleaning brush 235 relative to transfer drum 202.

Collection roller 238 is rotatably located to the left of cleaning brush 235. A bias voltage having a higher voltage level than but the same polarity as that impressed to cleaning brush 235 is applied to collection roller 238 so that it electrostatically collects contaminating toner T that is adsorbed to cleaning brush 235. Contaminating toner T that is electrostatically adsorbed to the surface of collection roller 238 is scraped off by scraper 239 located under collection roller 238 and housed inside collection box 240.

Backup brush 234 is located inside transfer drum 202. This backup brush 234 is arranged such that it faces cleaning brush 235 while being separated from it by the surface of transfer drum 202, that is, dielectric film 241. Backup brush 234 is electrically grounded so that the charge that is accumulated inside dielectric film 241 when cleaning brush 235 removes contaminating toner T is released. Backup brush 234 also works to ensure that cleaning brush 235 nips dielectric film 241. The timing at which cleaning brush 235 is pressed into contact with transfer drum 202, as well as said brush's rotational operation, is controlled by CPU 60 shown in FIG. 4.

Figure 4:
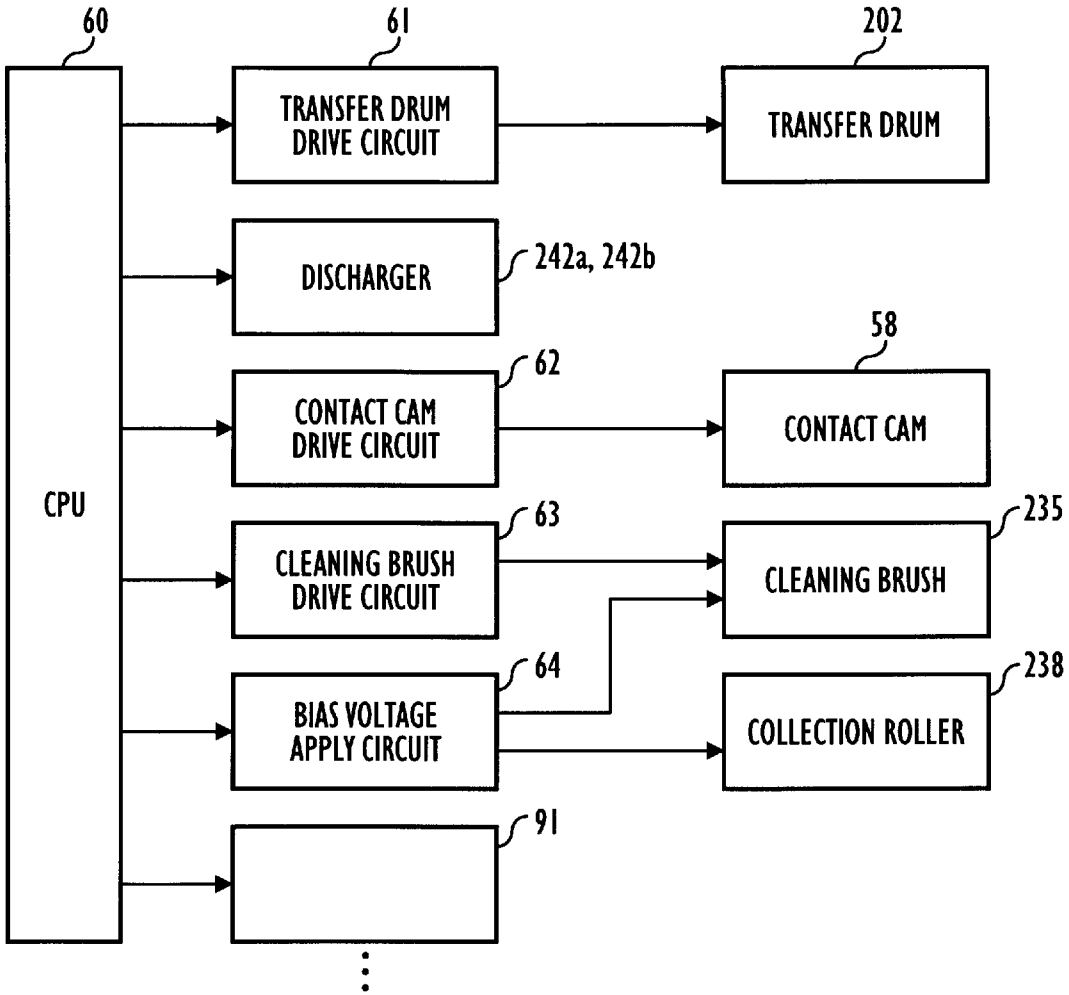
FIG. 4 is a block diagram showing the control circuit.

With reference to FIG. 4, the construction of the control system around the transfer drum will now be outlined. CPU 60 which works as the control center for the control system and for the entire copying machine is located at a prescribed position inside the color copying machine. As shown in the drawing, CPU 60 controls the drive of transfer drum 202 via transfer drum drive circuit 61 comprising a transfer drum drive motor, etc. In addition, CPU 60 controls the timing at which current is supplied to dischargers 242*a* and 242*b*, the drive of contact cam 58, the rotation of cleaning brush 235, and the timing at which a bias voltage 64 is applied to cleaning brush 235 and collection roller 238. The control of the drive of contact cam 58 is carried out by means of contact cam drive circuit 62. The control of the rotation of cleaning brush 235 is carried out by means of cleaning brush drive circuit 63 that has a cleaning brush drive motor, etc.

CPU 60 also has a function to cause touch panel 91 located on the operation panel of the main unit of the color copying machine to display messages such as 'Waiting'. Signals are supplied to CPU 60 from various keys located on the operation panel as well.

The control in this embodiment is explained below with reference to FIGS. 5 through 9.

Figure 5:
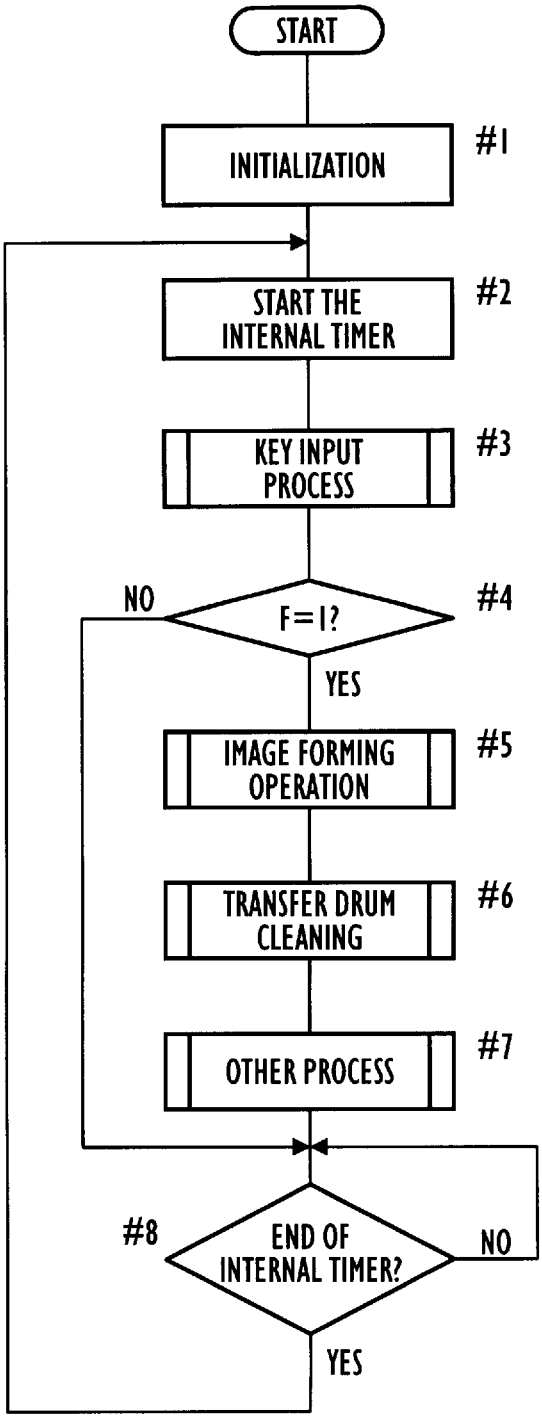
FIG. 5 is a flow chart showing the main routine.
Figure 6:
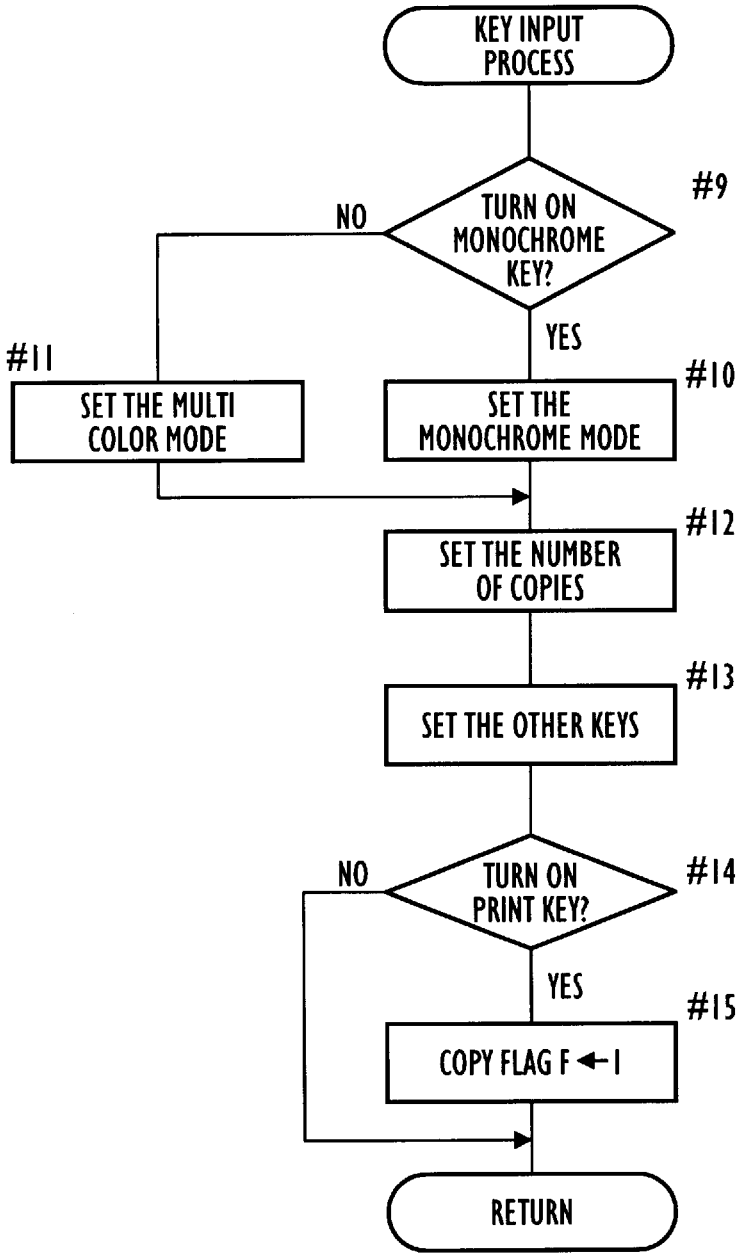
FIG. 6 is a flow chart showing the key input processing subroutine.

FIG. 5 shows the main routine of CPU 60. When power to the apparatus is turned ON, CPU 60 first carries out initialization of various members (step #1) and starts the internal timer (step #2). Next, after executing the key input processing subroutine in which signals input from the operation panel are processed (step #3), it determines whether or not copy flag F is 1 (step #4). This copy flag F is a flag that is set in the key input processing subroutine and its details are described below. When copy flag F is 1 (YES in step #4), CPU 60 executes the copy operation, i.e., the image forming operation (step #5), based on the operating conditions set in the key input processing subroutine, after which it executes the transfer drum cleaning subroutine (step #6). It then performs processing for the display on touch panel 91, temperature control as to fusing device 210, etc. (step #7). When the time set in the internal timer has elapsed (YES in step #8), the routine returns to step #2.

The key input processing subroutine mentioned above is explained below with reference to FIG. 6.

In this subroutine, CPU 60 first determines whether or not monochrome key 97 has been pressed to the ON position. Where monochrome key 97 has been pressed to the ON position (YES in step #9), the monochrome mode is set (step #10), while where monochrome key 97 has been pressed to the OFF position (NO in step #9), the color mode is set (step #11). CPU 60 then accepts the number input from numeric key pad 92 and sets the number of copies to be made (step #12). It then processes the input from other keys. Finally, CPU 60 determines whether or not 'on edge' status exists with regard to 'Print' key 96 (step #14). 'On edge' here refers to the switching from the OFF state to the ON state. If 'on edge' status exists with regard to 'Print' key 96 (YES in step #14), CPU 60 sets copy flag F described above to 1 (step #15). This copy flag is reset when the series of copy operations is completed. As described above, because the copy flag is set to 1 in step #15 when 'Print' key 96 is pressed, the copy operations (step #5) and the transfer drum cleaning (step #6) are executed in steps #5 through #7 of FIG. 5. When this happens, the image forming means carries out the copy operations under the operating conditions set in the key input processing subroutine, or in other words, in accordance with the monochrome mode or color mode set in step #10 or #11 and the number of copies set in step #12, as well as with other desired copy conditions.

Figure 7:
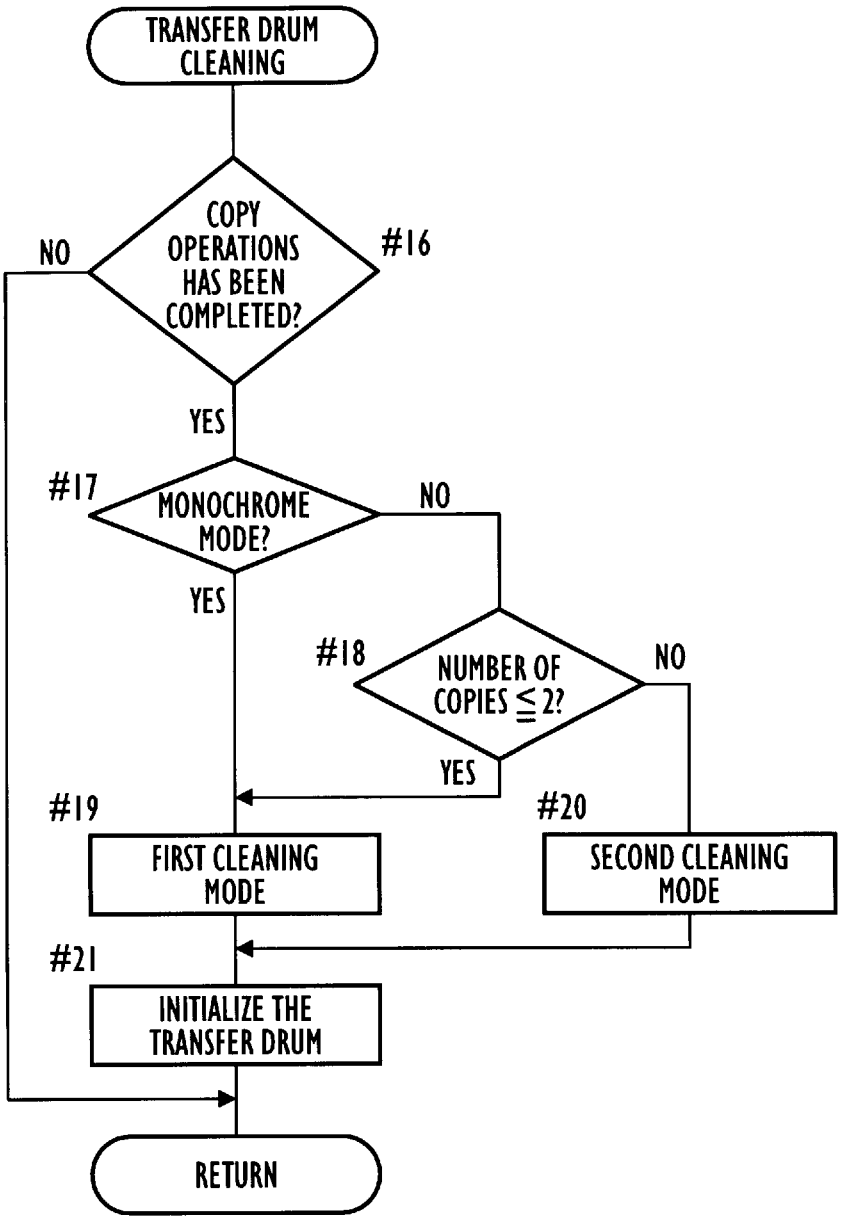
FIG. 7 is a flow chart showing the transfer drum cleaning subroutine.
Figure 8:
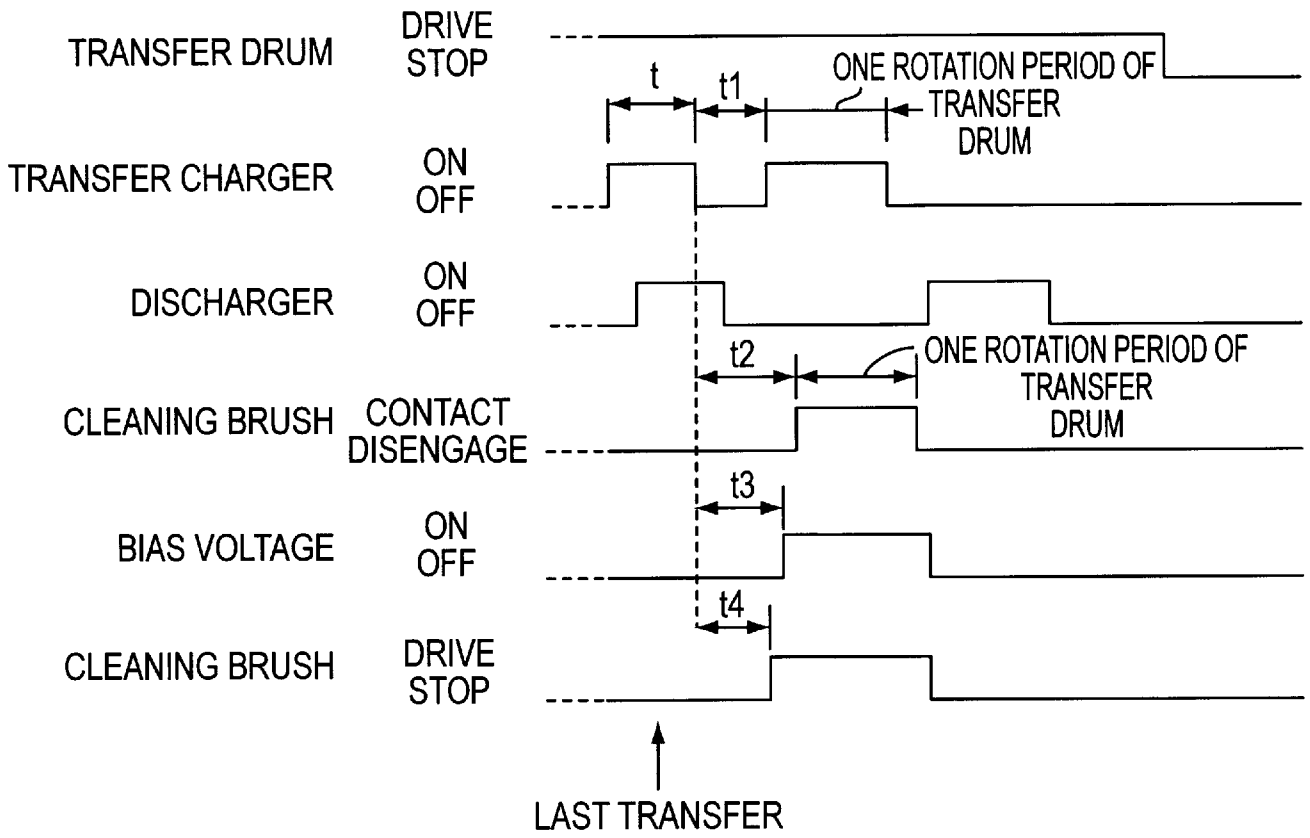
FIG. 8 is a timing chart showing a first cleaning mode.
Figure 9:
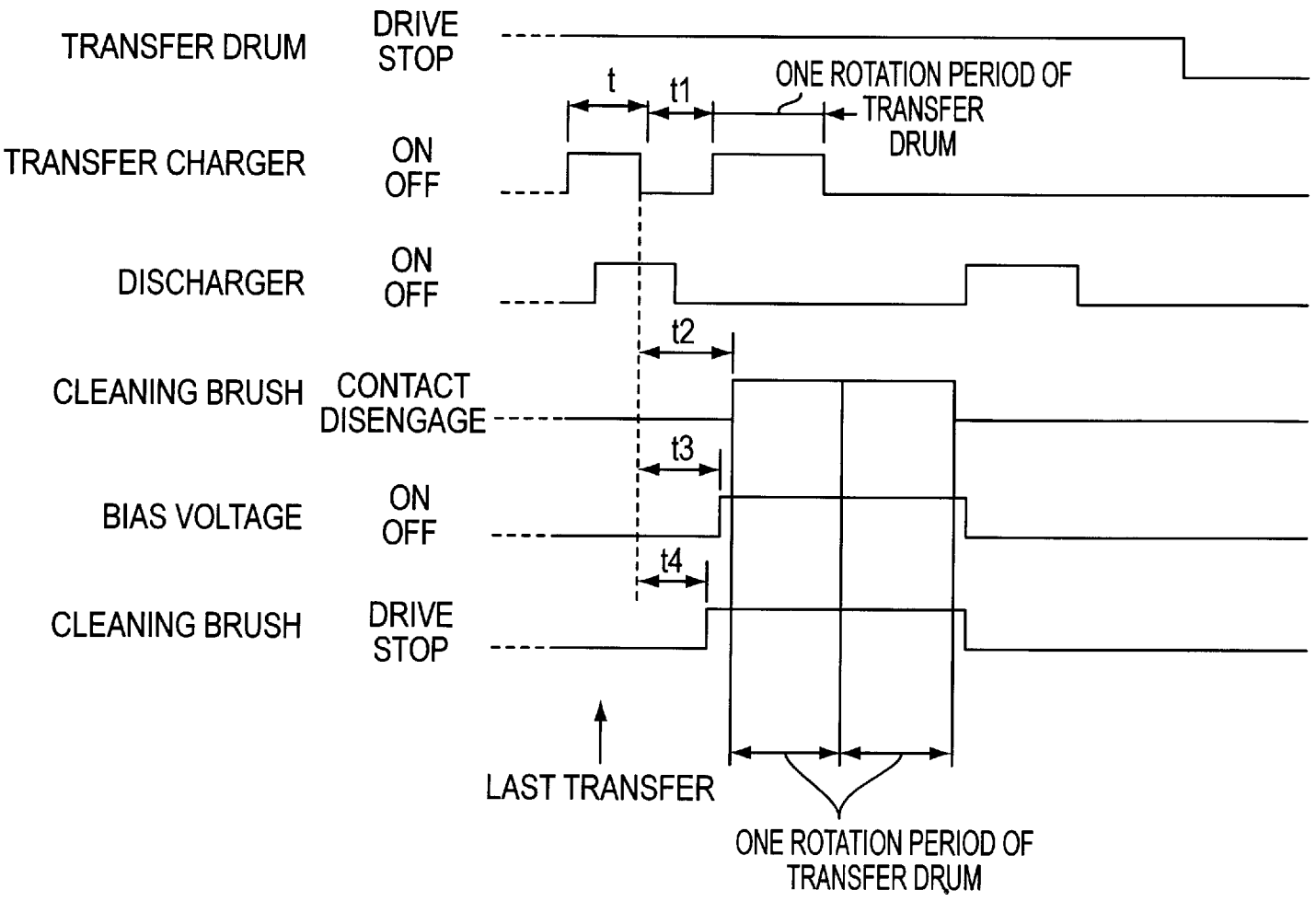
FIG. 9 is a timing chart showing a second cleaning mode.

The operation to clean transfer drum 202 is explained below with reference to FIGS. 7 through 9. As modes for the cleaning of transfer drum 202, this embodiment has a first cleaning mode and a second cleaning mode which differ in regard to the cleaning capacities (here, the operation period) of cleaning device 232 . FIGS. 8 and 9 show the timing charts for the first and second cleaning modes, respectively. The first cleaning mode will first be explained with reference to FIG. 8.

When the operation of transfer charger 205 over period t with regard to the last copy of the number of copies set in step #12 of the key input processing subroutine (hereinafter 'last transfer') has been completed, transfer charger 205 is turned OFF for period t1.When period t1 after the completion of the last transfer has elapsed, transfer charger 205 is turned ON for a period equivalent to the time required for one rotation of transfer drum 202 in order to recharge toner T on transfer drum 202. Next, when the time that has elapsed since the completion of the last transfer has become t4 (>t1), the rotation of cleaning brush 235 is begun. When the time that has elapsed since the completion of the last transfer has become t3 (>t4), a bias voltage is applied to cleaning brush 235. When the time that has elapsed since the completion of the last transfer has become t2 (>t3), contact cam 58 is driven via contact cam drive circuit 62 so that cleaning brush 235 is pressed into contact with the surface of transfer drum 202. When a period that is equivalent to the time required for one rotation of transfer drum 202 has elapsed, contact cam 58 is then driven again so that cleaning brush 235 is disengaged from transfer drum 202. Finally, the application of a bias voltage to cleaning brush 235 is stopped, and the rotation of cleaning brush 235 is stopped. Meanwhile, transfer drum 202 continues to rotate at a constant speed. In this way, in the first cleaning mode, the cleaning period in which transfer drum 202 is cleaned is equivalent to the time required for one rotation of transfer drum 202 after period t2 following the completion of the last transfer.

On the other hand, in the second cleaning mode shown in FIG. 9, when period t2 has elapsed since the completion of the last transfer, cleaning brush 235 is maintained pressed into contact with transfer drum 202 for a period equivalent to the time required for two rotations of transfer drum 202. In other words, in the second cleaning mode, the cleaning period in which transfer drum 202 is cleaned is equivalent to the time required for two rotations of transfer drum 202 after period t2 following the completion of the last transfer.

As is clear from the explanation provided above, the cleaning period in the first cleaning mode is shorter than that in the second cleaning mode. It is therefore effective when the level of contamination of transfer drum 202 is low. In addition, because there is little stress on the photosensitive drum, transfer drum and cleaning brush, their lives may be extended as well. Conversely, the cleaning period in the second cleaning mode is longer than that in the first cleaning mode. Therefore, the stress on transfer drum 202 and cleaning brush 235 is larger. However, it is advantageous in that it allows adequate cleaning when the level of contamination of transfer drum 202 is high. Thus, cleaning is carried out in the transfer drum cleaning subroutine (step #6 in FIG. 5) while alternating the first cleaning mode and the second cleaning mode. The transfer drum cleaning subroutine is explained in detail below with reference to FIG. 7.

In this subroutine, first, CPU 60 determines whether or not a series of copy operations, in other words, the copy operations as to the number of copies set in step #12 of the key input processing subroutine, has been completed. Where the series of copy operations has not been completed (NO in step #16), the main routine is returned to without the subsequent processes being performed. On the other hand, where the series of copy operations has been completed (YES in step #16), CPU 60 determines whether the last copy operation was in the monochrome mode or in the color mode (step #17). Where the last copy operation was in the monochrome mode (YES in step #17), transfer drum 202 is cleaned using the first cleaning mode. On the other hand, where the last copy operation was in the color mode (NO in step #17), CPU 60 determines whether the set number was two or less, or in other words, whether the number of copies was two or less (step #18). Where the set number was two or less, transfer drum 202 is cleaned using the first cleaning mode (YES in step #18, step #19), and where the set number was more than two, transfer drum 202 is cleaned using the second cleaning mode (NO in step #18, step #20). Finally, various settings with regard to transfer drum 202 are initialized (step #21) and the main routine is returned to the initialization (step #1).

As described above, in this embodiment, the first cleaning mode is executed when copying is carried out in monochrome mode or when the number of copies is two or less even though copying is carried out in color mode. This is because transfer drum 202 can be adequately cleaned in a short period of time when copying is done in the monochrome mode or when the number of copies is two or less in the color mode, since the contamination of transfer drum 202 is small and foreign objects on transfer drum 202 do not adhere strongly to said transfer drum. Consequently, the waste of excess cleaning time may be eliminated and the useful lives of transfer drum 202 and cleaning brush 235, as well as that of photosensitive drum 206 that rotates in synchronization with transfer drum 202, may be extended. On the other hand, when the number of copies is more than two, i.e., is three or more, in color mode, the level of contamination of transfer drum 202 may be high and foreign objects on transfer drum 202 may adhere strongly to said transfer drum. Therefore, the second cleaning mode having a longer cleaning period is executed. Consequently, even when the level of contamination of transfer drum 202 is high and foreign objects on transfer drum 202 are adhering strongly to said transfer drum, transfer drum 202 can be reliably cleaned.

In the embodiment described above, explanations were provided assuming that the monochrome mode is a mode in which only the black developer is used for copying. However, it may be a monocolor mode in which any one of the developers other than the black developer is used for copying.

Moreover, in the embodiment described above, the rotation speed of transfer drum 202 stays constant regardless of whether the first cleaning mode or the second cleaning mode is used. However, the rotation speed of transfer drum 202 may be changed depending on the cleaning mode present. For example, if the rotation speed of transfer drum 202 is reduced, the cleaning period that is required to clean transfer drum 202 over one rotation increases, which improves the cleaning capacity of cleaning device 233 with regard to transfer drum 202.

Figure 10:
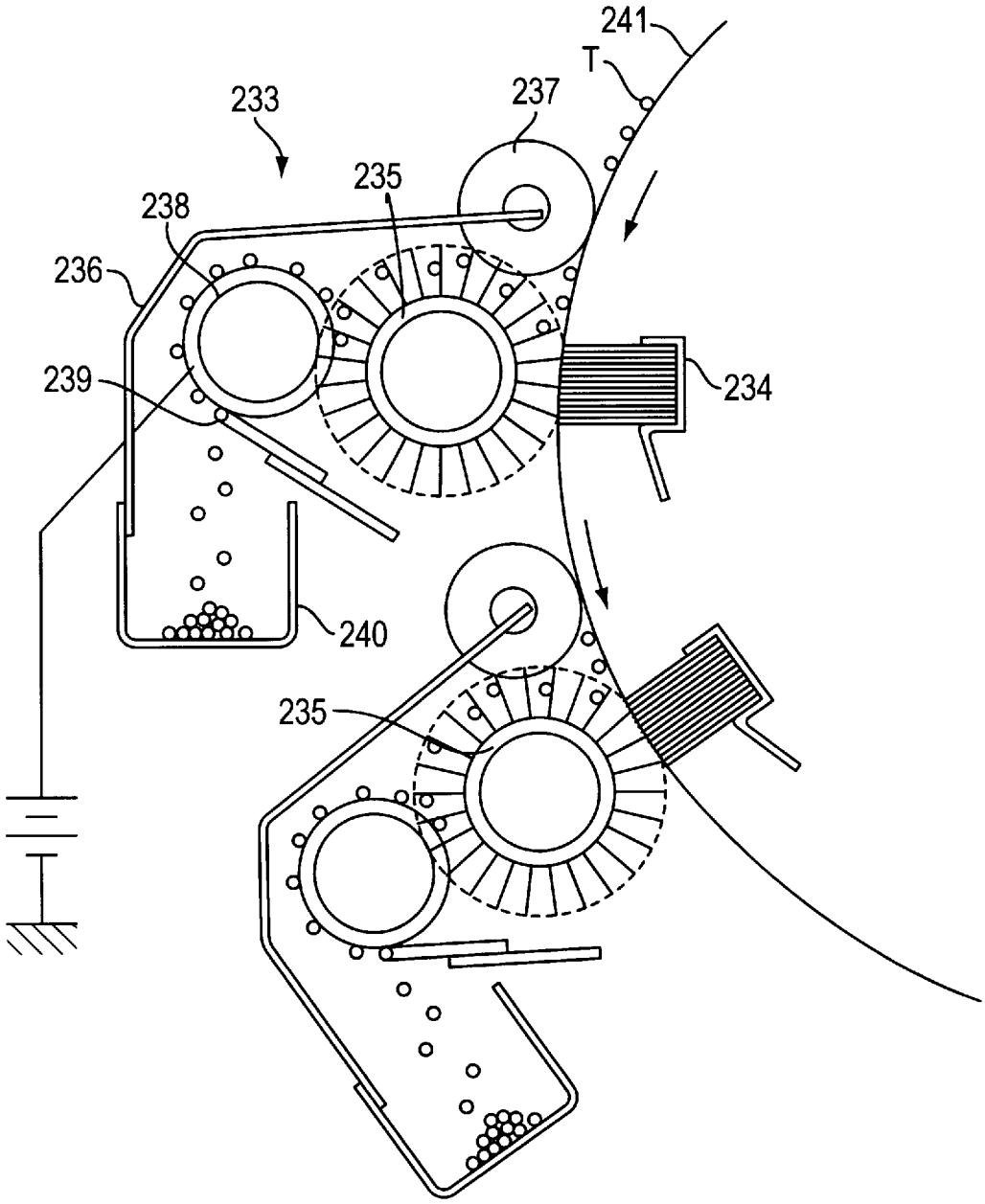
FIG. 10 is a cross-sectional view showing an alternate embodiment of the cleaning device having multiple cleaning brushes.

The method to switch the cleaning capacity of cleaning device 233 is not limited to the method in which the cleaning period is changed. For example, multiple cleaning mechanisms, such as cleaning brushes 235 as illustrated in FIG. 10, may be used and the cleaning capacity may be switched by means of changing the number of cleaning mechanisms that operate. Depending on the mode present, only one cleaning mechanism may be operated or multiple cleaning mechanisms may be operated, for example.

Figure 11:
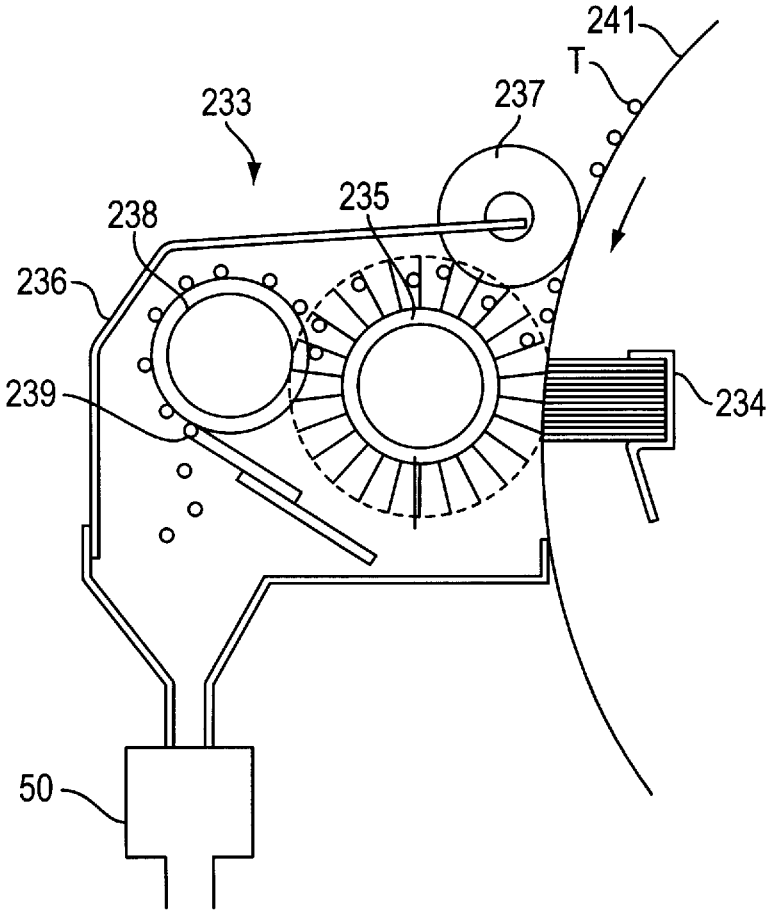
FIG. 11 is a cross-sectional view showing an alternate embodiment of the cleaning device having an air suction fan.

Furthermore, in the embodiment explained above, an example is provided in which the cleaning means comprises a fur brush to which a bias voltage is applied. However, a cleaning device employing a method in which contaminating toner, etc., is removed by air suction using a fan 50 may be used instead, as illustrated in FIG 11.

In addition, in the embodiment explained above, explanations were provided in regard to a situation in which the supporting member holding the paper is a transfer drum. However, the present invention is not limited to this, and the supporting member may be a member such as a transfer belt.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a photosensitive member on which an electrostatic latent image is formed and which carries a toner image;

a developing device which develops said electrostatic latent image and forms the toner image on said photosensitive member;

a transfer drum having a surface, which holds paper wrapped around it and can rotate;

a transfer member which transfers the toner image carried on said photosensitive member onto the paper wrapped around said transfer drum;

an operation panel that is used to set operating conditions with regard to various mechanisms described above in order to form an image on the paper;

a cleaning device which cleans the surface of said transfer drum while it rotates without any paper around it after the image forming operation is completed; and a controller which causes said transfer drum to rotate without any paper around it for various periods of time in accordance with said operating conditions, said transfer drum rotating at least 360 degrees, and said image forming apparatus being operable either in a monocolor mode in which image formation is performed using one color toner or a color mode in which image formation is performed by synthesizing multiple toner images, and said controller causing said transfer drum to rotate without any paper around it for a certain period of time when said image forming apparatus operates in the monocolor mode regardless of said operating conditions and changes the period of time in which said transfer drum rotates without any paper around it, depending on said operating conditions, when said image forming apparatus operates in the color mode.

2. The image forming apparatus claimed in claim 1, wherein said cleaning device has a brush that comes into contact with the surface of said transfer drum and a power supply that impresses a cleaning bias to said brush.

3. The image forming apparatus claimed in claim 1, wherein said controller makes the period of time in which said transfer drum rotates without any paper around it when multiple copies are made using the color mode longer than when copying is completed using the monocolor mode.

4. The image forming apparatus claimed in claim 1, wherein said image forming apparatus has a contact mechanism that causes said cleaning device to come into contact with and move away from the surface of said transfer drum.

5. An image forming apparatus comprising:

a photosensitive member on which an electrostatic latent image is formed and which carries a toner image;

a developing device, which develops, said electrostatic latent image and forms the toner image on said photosensitive member;

a transfer drum having a surface that holds paper wrapped around it and can rotate;

a transfer member which transfers the toner image carried on said photosensitive member onto the paper wrapped around said transfer drum;

an operation panel which is used to set operating conditions with regard to various mechanisms described above in order to form an image on the paper;

a cleaning device which cleans the surface of said transfer drum while it rotates without any paper around it after the image forming operation is completed; and a controller which causes said transfer drum to rotate without any paper around it for various periods of time in accordance with said operating conditions, said transfer drum rotating at least 360 degrees, and said operating conditions referring to the number of prints for which image formation is continuously carried out, and said controller controlling a period of time in which the transfer drum rotates without any paper around it depending on the number of prints for which image formation was carried out.

6. The image forming apparatus claimed in claim 5, wherein said cleaning device has a brush that comes into contact with the surface of said transfer drum and a power supply that impresses a cleaning bias to said brush.

7. The image forming apparatus claimed in claim 5, wherein said image forming apparatus has a contact mechanism that causes said cleaning device to come into contact with and move away from the surface of said transfer drum.

8. The image forming apparatus comprising:

an image carrier for carrying the toner image;

a developing device for forming the toner image on said image carrier;

a supporting mechanism having a surface for holding a paper such that it faces said image carrier;

a transfer member for transferring the toner image carried on said image carrier onto the paper held by said supporting mechanism;

a cleaning device for cleaning the surface of said supporting mechanism; and a controller for controlling the cleaning capacity of said cleaning device in response to conditions of operation which form an image on the paper using the components described above, said supporting mechanism rotating at least 360 degrees, said image forming apparatus being a color image forming apparatus capable of monocolor image formation and multi-color image formation, and said controller controlling the cleaning capacity depending on whether a monocolor mode in which monocolor image formation is carried out, or a color mode-in which image formation is carried out by synthesizing multiple toner images, is present.

9. The image forming apparatus claimed in claim 8, wherein said cleaning device has a rotatable brush that comes into contact with the surface of said supporting mechanism and removes residual toner, and a drive member that rotates said brush.

10. The image forming apparatus claimed in claim 9, further comprising a power supply for applying a cleaning bias to said brush.

11. The image forming apparatus claimed in claim 9, wherein said cleaning device has multiple brushes that may be operated individually, and said controller controls the cleaning capacity by controlling the number of brushes to be operated from among said multiple brushes depending on the operating conditions.

12. The image forming apparatus claimed in claim 9, wherein said image forming apparatus has a contact mechanism that causes said cleaning device to come into contact with and move away from the surface of the supporting mechanism.

13. The image forming apparatus claimed in claim 8, wherein said controller sets the cleaning capacity to high when multiple continuous prints are made using the color mode.

14. The image forming apparatus claimed in claim 8, wherein said cleaning capacity of the cleaning device controlled by said controller is an operation period in which the cleaning device operates.

15. The image forming apparatus claimed in claim 8, wherein said supporting mechanism holds paper by means of static adsorption.

16. The image forming apparatus claimed in claim 8, wherein said cleaning device has a suction mechanism that removes toner remaining on the surface of said supporting mechanism by means of air suction.

17. A transfer drum cleaning method used in an image forming apparatus having a rotatable transfer drum that holds paper wrapped around its surface, an image forming mechanism that forms an image on the paper wrapped around said transfer drum, and a cleaning device that cleans said transfer drum, said cleaning method comprising the steps of:

determining the completion of an image formation operation;

detecting operating conditions for the completed image formation;

setting a cleaning mode that corresponds to the operating conditions from among multiple cleaning modes, said cleaning mode being an operation period in which the cleaning device operates; and executing cleaning of the transfer drum using the cleaning mode that is set, said transfer drum rotating at least 360 degrees, said image forming apparatus being a color image forming apparatus capable of monocolor image formation and multi-color image formation, and selecting a cleaning mode with a longer operation period when a color mode in which image formation is carried out by synthesizing multiple toner images is detected as one of the operating conditions.

18. A transfer drum cleaning method used in an image forming apparatus having a rotatable transfer drum that holds paper wrapped around its surface, an image forming mechanism that forms an image on the paper wrapped around said transfer drum, and a cleaning device that cleans said transfer drum, said cleaning method comprising the steps of:

determining the completion of an image formation operation;

detecting operating conditions for the completed image formation;

setting a cleaning mode that corresponds to the operating conditions from among multiple cleaning modes; and executing cleaning of the transfer drum using the cleaning mode that is set, wherein said transfer drum rotates at least 360 degrees, said image forming apparatus being a color image forming apparatus capable of monocolor image formation and multi-color image formation, and selecting a cleaning mode with a longer operation period when multiple continuous prints are made using a color mode.

* * * * *